US006427765B1

(12) United States Patent
Han et al.

(10) Patent No.: US 6,427,765 B1
(45) Date of Patent: Aug. 6, 2002

(54) HEAT-PIPE HAVING WOVEN-WIRED WICK AND METHOD FOR MANUFACTURING THE SAME

(76) Inventors: Jae Sup Han; Young Soo Lee; Kwang Soo Kim, all of Daejeon (KR)

( * ) Notice: Subject to any disclaimer, the term of this patent is extended or adjusted under 35 U.S.C. 154(b) by 0 days.

(21) Appl. No.: 09/435,805

(22) Filed: Nov. 8, 1999

Related U.S. Application Data

(63) Continuation-in-part of application No. 09/163,058, filed on Sep. 29, 1998, now abandoned.

(51) Int. Cl.[7] ..... F28D 15/00
(52) U.S. Cl. ..... 165/104.26; 29/890.032
(58) Field of Search ..... 165/104.26; 29/890.032; 431/325

(56) References Cited

U.S. PATENT DOCUMENTS

| | | | | | |
|---|---|---|---|---|---|
| 1,719,679 | A | * | 7/1929 | Muller-Thym | 431/325 |
| 2,210,290 | A | * | 8/1940 | Heinsohn | 431/325 |
| 2,829,511 | A | * | 4/1958 | Oesterle et al. | 431/325 |
| 4,311,733 | A | | 1/1982 | Inoue | |
| 4,921,041 | A | | 5/1990 | Akachi | |
| 5,785,088 | A | * | 7/1998 | Pai | 165/104.26 X |

FOREIGN PATENT DOCUMENTS

| | | | | |
|---|---|---|---|---|
| JP | 0001936 | * | 1/1979 | 431/325 |
| JP | 0067793 | * | 4/1982 | 165/104.26 |
| JP | 0062596 | * | 4/1985 | 165/104.26 |
| SU | 0800576 | * | 1/1981 | 165/104.26 |
| SU | 0808826 | * | 3/1981 | 165/104.26 |
| SU | 0974087 | * | 11/1982 | 165/104.26 |
| SU | 1000724 | * | 2/1983 | 165/104.26 |

OTHER PUBLICATIONS

Kim et al., "Coding Characteristics of Minature Heat Pipes Woven–Wired Wick", pp. 20–25.

* cited by examiner

*Primary Examiner*—Christopher Atkinson
(74) *Attorney, Agent, or Firm*—Jacobson Holman, PLLC

(57) ABSTRACT

A heat pipe having a woven-wired wick according to the present invention is for improving a capillary force and permeability and simplifying the manufacturing process thereof. The heat pipe uses a wick in order to increase permeability. The heat pipe comprises a pipe body; and a wick having a larger diameter than that of the pipe body before being inserted into the pipe body and a smaller diameter than that of the pipe body after being inserted into the pipe body. The wick includes a plurality of groups of wires which are spirally woven to form a cylindrical wick and each wire is made of a material having an elasticity. In addition, the heat pipe is manufactured by the following steps: forming a cylindrical wick by weaving a plurality of wires spirally so that a diameter of the wick is larger than an inner diameter of a pipe body; and inserting the wick into the pipe body, wherein the diameter of the wick is smaller than the diameter of the pipe body and the wick is closely in contact with an inner wall of the pipe body without any process due to elasticity of the wire when the wick is inserted into the pipe body.

9 Claims, 6 Drawing Sheets

HEAT-PIPE HAVING WOVEN-WIRED WICK AND METHOD FOR MANUFACTURING THE SAME

This application is a c-i-p of Ser. No. 09/163,058 filed Sep. 29, 1998 abn.

BACKGROUND OF THE INVENTION

1. Field of the Invention

The present invention relates to a heat-pipe; and more particularly, to a heat-pipe having a woven-wired wick which can improved the efficiency of the heat pipe by increasing a permeability of the heat-pipe.

2. Description of Prior Art

Heat pipe is an apparatus effectively transferring heat by non-power even in a little temperature difference due to the use of latent heat caused by the vaporization and condensation of the fluid carrying heat. FIG. 1 describes the operation principle of a heat pipe. As shown in FIG 1, the heat pipe has fluid carrying heat and is sealed in a condition of a vacuum. Fluid carrying heat is vaporized at vaporization portion 20 and, while its vapor is spraying out toward inner part of pipe a 10, passes through transportation portion 30 and radiates the heat at condensation portion 40. After that, recirculating to vaporization portion 20 along the surface of a wall in a liquid phase, it carries out heat transfer by recirculating vaporizing operation by the heat transferred. In such a heat pipe, the efficiency of the pipe may be influenced on kinds and quantity of injection of fluid carrying heat, the vacum condition and the purity of inner part of pipe, etc., but it is particularly important to have the liquid condensed at condensation portion 40 recirculated to vaporization portion 20. Generally, the heat pipe induces capillary force by inserting a wick in order for the circulation of fluid carrying heat or by manufacturing grooves inside of a wall and fluid carrying heat may be circulated by means of capillary force caused by sealing both end parts of the pipe after injecting reasonable quantity of fluid carrying heat to the inside of pipe conditioned to a vacuum. That is, recirculation toward vaporization portion 20 liquid condensed at condensation portion 40 mostly depends on the capillary force. In order to provide the capillary force, a wick may be inserted or grooves are manufactured inside of the pipe. In FIG. 2, screen mesh 55, which is used as a wick, is inserted within the pipe 10. In FIG. 3, wires 65, which are used as a wick, are inserted to a surface of an inside wall of a pipe 10 and then contact closely with inside wall by means of spring 68. In addition, in FIG. 4, capillary force is provided by forming groove 75 on the inside wall of the pipe 10.

However, these conventional heat pipe have the problem that the heat pipe having excellent heat transfer property is difficult to be manufactured while the heat pipe that can be comparatively easily manufactured, has a bad heat transfer property.

SUMMARY OF THE INVENTION

Accordingly, an object of the present invention is to provide a heat pipe, which can be easily manufactured and has an excellent heat transfer property.

In accordance with one embodiment of the present invention to accomplish the above object, there is provided a heat pipe, comprising: a pipe body; and a wick having a larger diameter than that of the pipe body before being inserted into the pipe body and a smaller diameter than that of the pipe body after being inserted into the pipe body, wherein the wick includes a plurality of groups of wires which are spirally woven to form a cylindrical wick and each wire is made of a material having an elasticity.

In accordance with another embodiment of the present invention to accomplish the above object, there is provided a heat pipe, comprising: a pipe body; and a wick having a larger diameter than that of said pipe body before being inserted into said pipe body and a smaller diameter than that of said pipe body after being inserted into said pipe body, wherein said wick includes a plurality of wires which are spirally woven to form a cylindrical wick; and wherein the cylindrical wick has a restoration force for maintaining an original In accordance with further another embodiment of the present invention to accomplish the above object, there is provided a method for manufacturing a heat pipe, comprising the steps of: forming a cylindrical wick by weaving a plurality of wires spirally so that a diameter of the wick is larger than an inner diameter of a pipe body; and inserting the wick into the pipe body, wherein the diameter of the wick is smaller than the diameter of the pipe body and the wick is closely in contact with an inner wall of the pipe body without any process due to elasticity of the wire when the wick is inserted into the pipe body.

BRIEF DESCRIPTION OF THE DRAWINGS

A further understanding of the nature and advantage of the present invention will become apparent by reference to the remaining portions of the specification and drawings, in which.

DETAILED DESCRIPTION OF THE PREFERRED EMBODIMENT

A detailed description of embodiments according to the present invention will be given below with reference to accompanying drawings.

Figure 5A:
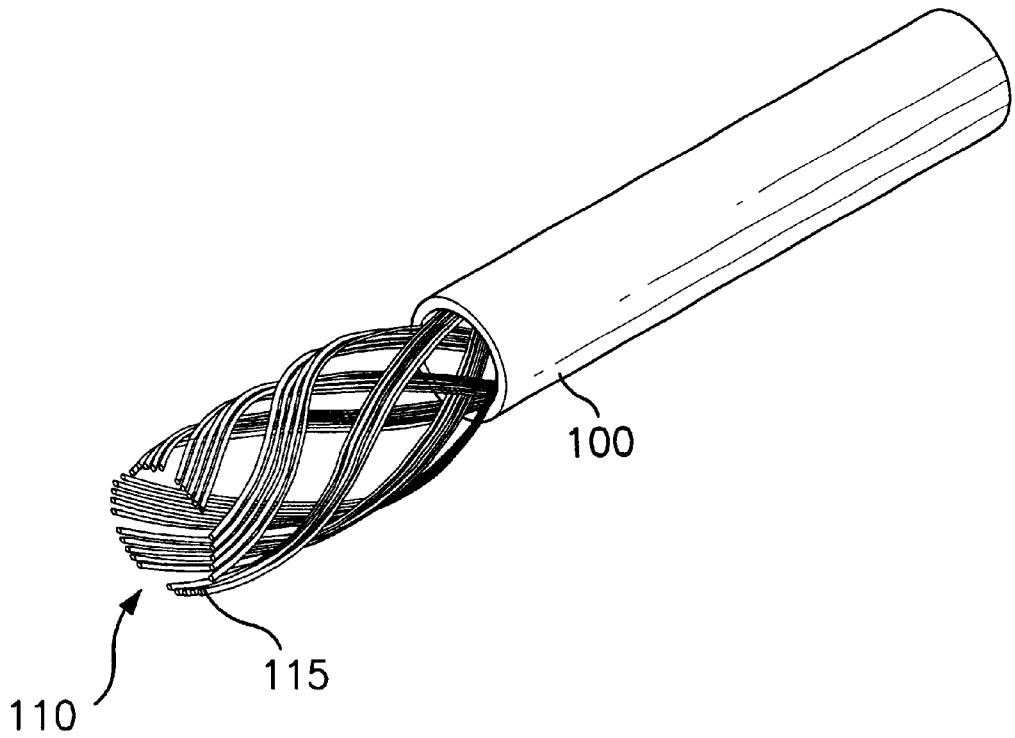
FIGS. 5A and 5B are a perspective view and a cross-sectional view for explaining a heat pipe having a woven-wired wick according to the present invention.
Figure 5B:
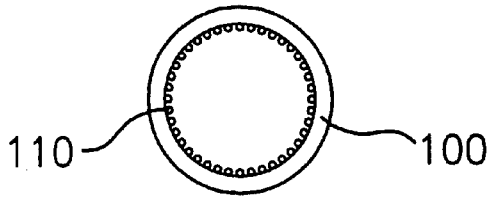

FIGS. 5A and 5B are perspective view and cross-sectional view respectively, for explaining a heat pipe having a woven-wired wick according to the present invention. FIG. 5A is a perspective view illustrating an insertion operation of wick 110, which is inserted into the inside of the pipe 100. The wick 110 comprises a plurality of groups of wires 115 which are spirally woven and formed to a cylindrical. The cylindrical wick has a restoration force for maintaining an original diameter. FIG. 5B is a cross-sectional view illustrating the inserted state of the wick 110 within the pipe 100.

As shown in FIGS. 5A and 5B, the pipe 100 is formed into the cylindrical shape and the wick 110 comprises a plurality of groups of wires 115 which are made of material having a great quality of elasticity.

Figure 1:
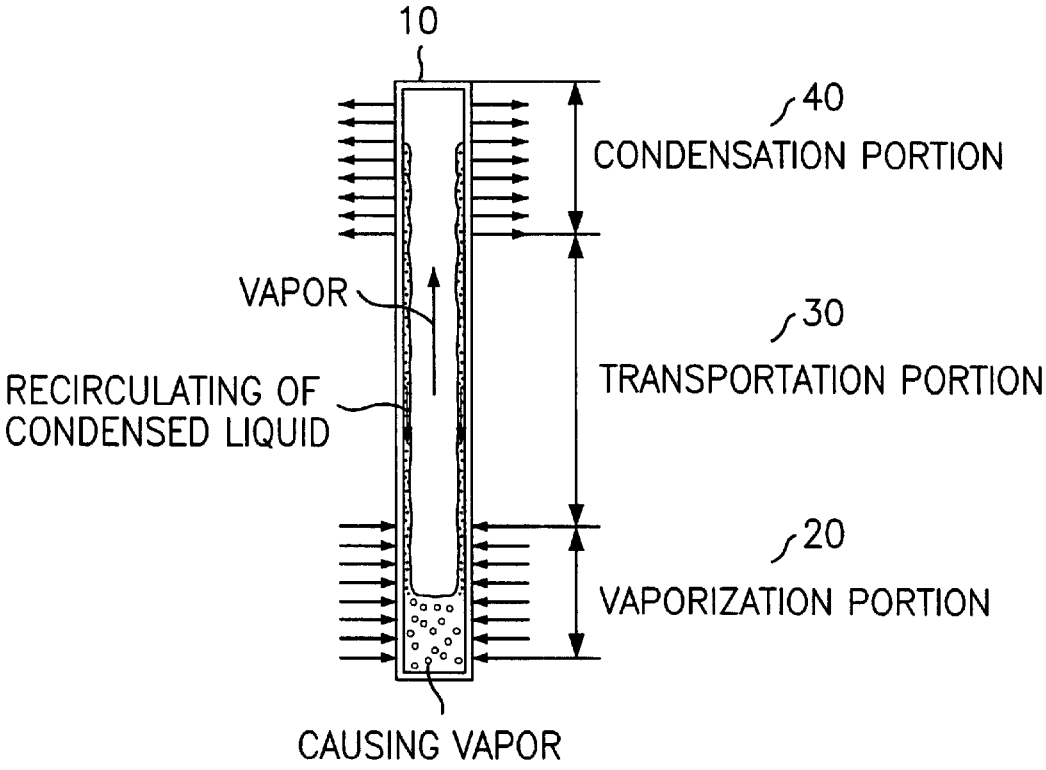
FIG. 1 is a cross-sectional view for explaining the operation principle of a heat pipe.
Figure 2A:
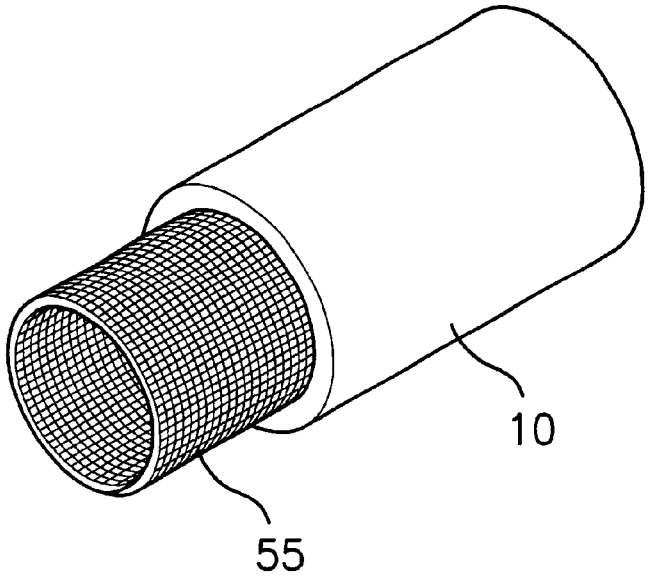
FIG. 2A (PRIOR ART)
FIGS. 2A and 2B are cross-sectional views illustrating an example of conventional heat pipe.
Figure 2B:
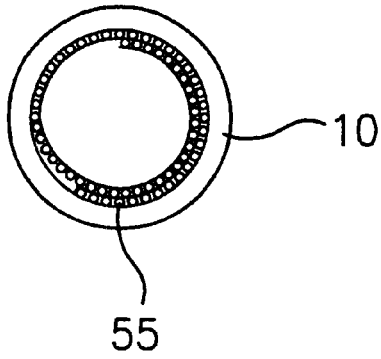
FIG. 2B (PRIOR ART)
Figure 3A:
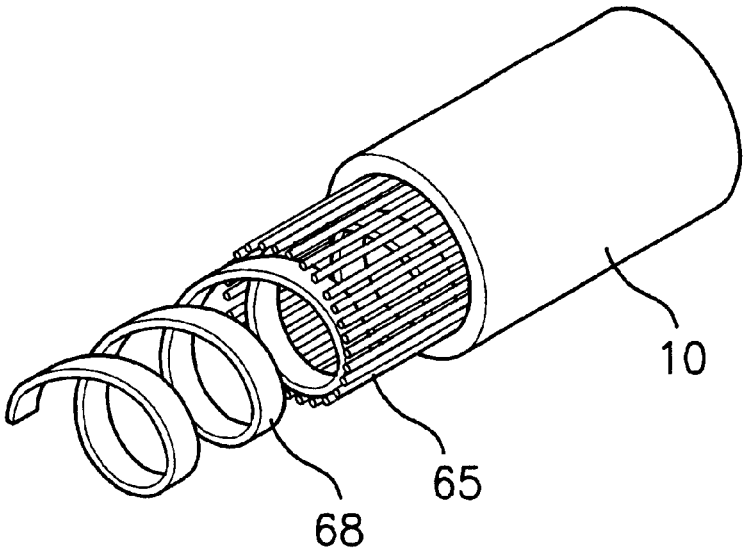
FIG. 3A (PRIOR ART)
FIGS. 3A and 3B are a perspective view and a cross-sectional view illustrating another example of conventional heat pipe.
Figure 3B:
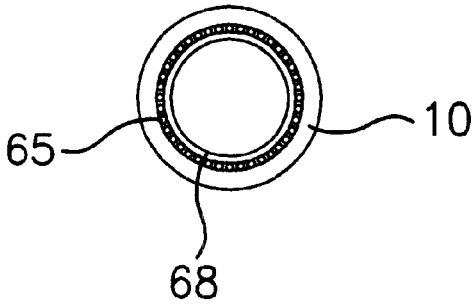
FIG. 3B (PRIOR ART)
Figure 4A:
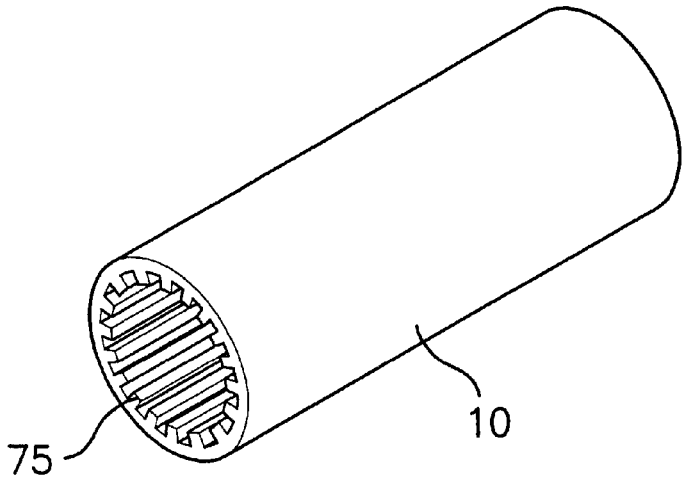
FIG. 4A (PRIOR ART)
FIGS. 4A and 4B are a perspective view and a cross-sectional view illustrating a third example of conventional heat pipe.
Figure 4B:
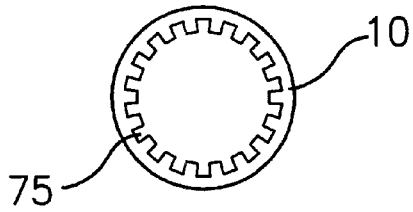
FIG. 4B (PRIOR ART)

The plurality of groups of wires 115 are spirally woven together, so that the wick has a larger diameter than that of the pipe body 100. The the woven-wired wick is inserted into the pipe body 100, the diameter of the wick is smaller than that of the pipe body 100. Since the cylindrical wick has a restoration force and the wires have the elasticity, the wires contained in the woven-wired wick are closely contacted to the inside wall of the pipe body 100 without an additional device the processing, for example, a spring shown in FIG. 3.

At th e center portion of the pipe body 100, an opening to be used as vapor passage is made. Since the wick has a great quality of elasticity and a restoration force, the woven-wired wick according to, the present invention is easily extended in axial direction. The wick is simply pushed into the pipe body by a device such as a stick.

After inserted to the pipe body, the wick is automatically in contact with the inner wall of the pipe body due to the restoration force and the elasticity of the wick 110.

Here, the embodiments for the woven wires will be explained as examples, but it will be appreciated by one skilled in the art that these examples can't be used to limit the scope of the invention.

For example, when the inner diameter of the heat pipe is 2.4 mm, the diameter of the wire may be 0.08 mm, and 16 wire groups are woven together, that is, they are regularly inter-crossed with each other, where one wire group is composed of four wires. However, for only easy description of the drawings, in FIGS. 5A–6B, the wick has six groups of wires and a group consists of five wires. According to another example, when the inner diameter of the heat pipe is 5 mm, the diameter of the wire is 0.1 mm, one wire group is made of 6 wires and 24 wire groups are woven. Also, when the inner diameter of the heat pipe is 3–10 mm, the diameter of the wire can be 0.08–0.1 mm, for effectiveness. Here, the wires are preferably made of metal having high purity such as, copper (Cu of, for example 99.999% purity) or stainless steel.

In a preferred embodiment of the present invention, the number of wires and diameter of the wire can be determined based on the inner diameter of the heat pipe. For strong capillary force and permeability of the heat pipe, the wires are preferably fine. Also, the distance in axial direction is called as pitch when the wire goes around the pipe body in one time. When the inner diameter of the pipe is 2.4 mm, the pitch of the wick is preferably 40 mm for maximum capillary force and permeability. At this time, the spiral lead angle is about 80° The pitch can be varied in accordance with the outer diameter of the woven wick, the inner diameter of the pipe body or a number of wire groups. Thus, the woven density of the wires is preferably represented by the spiral lead angle rather than the pitch. Here, irrespective of the inner diameter of the heat piper the spiral lead angle $\alpha$ means an angle between the spiral direction of the wire and the radial direction of the pipe body. The spiral lead angle $\alpha$ is 78°–82° for the sake of maximizing the capability of the heat pipe.

Figure 6A:
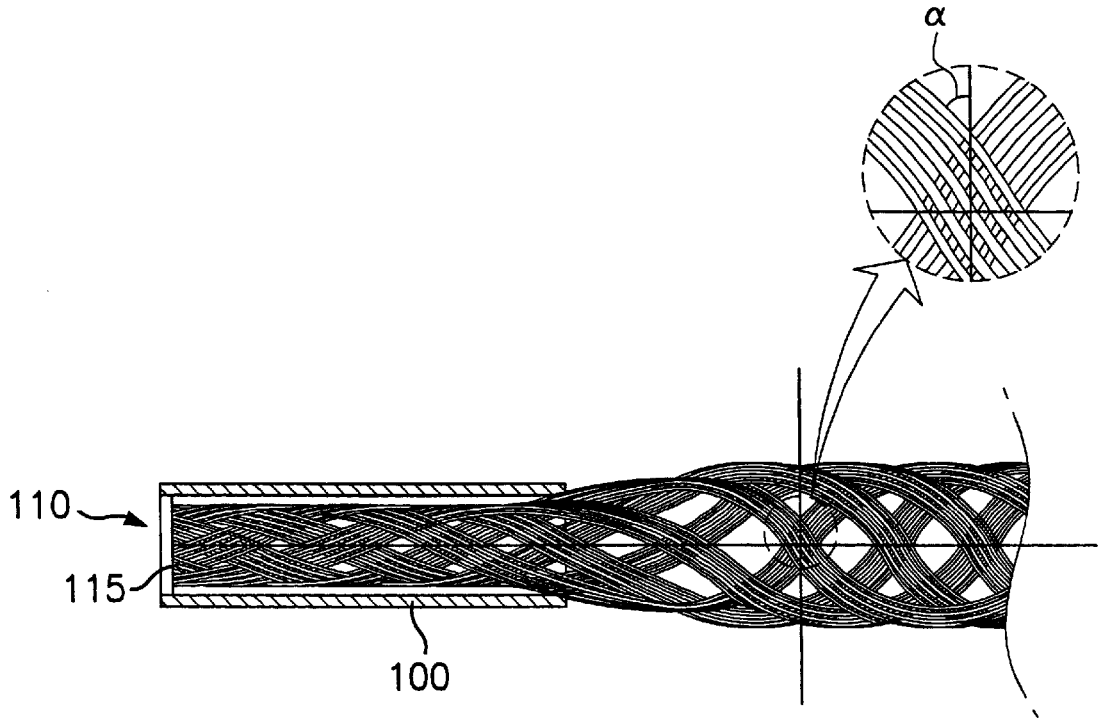
FIGS. 6A and 6B are cross-sectional views for explaining a method for inserting a wick of a heat pipe according to the present invention.
Figure 6B:
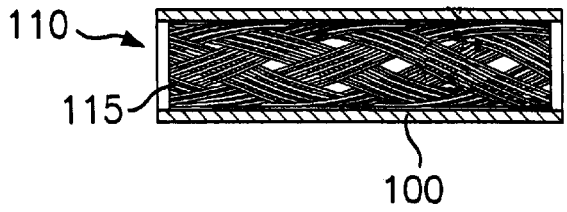

FIGS. 6A and 6B are cross-sectional views for explaining an operation of inserting the wick 110 into the heat pipe 100 according to the present invention.

Referring to FIG. 6A, the wick 110 comprising a plurality of wires 115 spirally woven together has a diameter which is lager than that of the pipe body 100. The woven-wired, wick 110 can be extended in axial direction, thereby the wick 110 can be easily inserted to the pipe body 100. The woven-wired wick is simply pushed into the inside of the pipe body 100 by a device such as a stick. When the wick 110 is inserted into the pipe body 100, the diameter of the wick 110 is smaller than the inner diameter of the pipe body 110.

Referring to FIG. 6A, as the mentioned above after the wick 110 is inserted into the pipe 100, the outer diameter of the wick 110 is smaller than that of the pipe body 100. The wick 110 is in closely contact with the inner wall of the pipe body 100 due to the restoration force and the elasticity of the wick 110. Also, the plurality of wires 115 of the wick are in evenly contact with the inner wall of the pipe 100. The restoration force and elasticity make the wick 110 to be closely contact with the pipe body 100, thereby the permeability of the heat pipe increases.

As described above, the wick comprising a plurality of wires woven in a spiral direction and overall formed into the cylindrical shape is inserted into the pipe. Here, before inserting the wick, the outer diameter of the woven-wired wick is larger than the inner diameter of the pipe. After inserting the wick, the outer diameter of the wick is smaller than that of the pipe body 110 and the spiral lead angle increases. In turn, the wires of the wick are evenly in contact with the inner wall of the pipe.

Thus, in the present invention, the heat pipe has a considerably improved permeability since reach wire is closely contacted with and evenly distributed on the inner wall of the pipe body and the spiral lead angle of the wires is larger when the wick in inserted into the pipe body. Also, the manufacturing process of the heat pipe is simplified since the wires of the woven-wired wick have elasticity and the cylindrical woven-wired wick has a restoration force for maintaining an original diameter.

While the present invention has been described in connection with specific embodiments accompanied by the attached drawings, it will be readily appreciated that various changes and modifications may be made thereto without departing the spirit of the invention.

What is claimed is:

1. A heat pipe, comprising:

a pipe body; and a plurality of groups of substantially parallel wires spirally woven to form a substantially cylindrical wick, each wire being made of a material having an elasticity such that said wick may be extended while retaining a restorative force, said wick having a larger diameter than that of said pipe body before being inserted into said pipe body and, following extension of said wick for insertion into said pipe body, said wick having a diameter just smaller than an inner wall of said pipe body after being inserted into said pipe body, said wick through said restorative force tightly contacting said inner wall of said pipe body along a complete inner circumference thereof.

2. The heat pipe according to claim 1, wherein the cylindrical wick is made such that a spiral lead angle is approximately 78° to 82°.

3. The heat pipe according to claim 1, wherein, when said wick is inserted into said pipe body, a spiral lead angle of said groups of wires becomes larger than an original spiral lead angle thereof.

4. The heat pipe according to claim 1, wherein one group of wires is substantially in contact with adjacent groups of wires when said wick is inserted into said pipe body.

5. The heat pipe according to claim 2, wherein, when said wick is inserted into said pipe body, a spiral lead angle of said groups of wires becomes larger than an original spiral lead angle thereof.

6. The heat pipe according to claim 5, wherein one group of wires is substantially in contact with adjacent groups of wires when said wick is inserted into said pipe body.

7. A method for manufacturing a heat pipe, comprising the steps of:

forming a cylindrical wick by weaving a plurality of groups of substantially parallel wires spirally with one another so that a diameter of the wick resulting from the spiral weaving of the plurality of groups of substantially parallel wires is larger than an inner diameter of a pipe body; and inserting the wick into the pipe body, said step of inserting including axially extending said wick and thereby reducing a diameter thereof so that the diameter of the wick is just smaller than the inner diameter of the pipe body, a restorative force in said wire resisting said axial extension and pressing said wick closely in contact with said pipe body along an entire inner wall thereof.

8. The method according to claim 7, wherein the cylindrical wick is made such that a spiral lead angle is approximately 78° to 82°.

9. The method according to claim 8, wherein, when said wick is inserted into said pipe body, a spiral lead angle of the wire becomes larger than an original spiral lead angle thereof.

* * * * *

UNITED STATES PATENT AND TRADEMARK OFFICE

CERTIFICATE OF CORRECTION

PATENT NO. : 6,427,765 B1
DATED : August 6, 2002
INVENTOR(S) : Jae Sup Han et al.

It is certified that error appears in the above-identified patent and that said Letters Patent is hereby corrected as shown below:

Title page,
Item [73], add -- [73] Assignee: Electronics and Telecommunications Research Institute of Taejon, Korea. --

Signed and Sealed this

Fourth Day of February, 2003

JAMES E. ROGAN
*Director of the United States Patent and Trademark Office*